US007370684B2

(12) United States Patent
Padan et al.

(10) Patent No.: US 7,370,684 B2
(45) Date of Patent: May 13, 2008

(54) DOOR SHUTTER MECHANISM

(75) Inventors: Tal Padan, Moshav Gan Hashomron (IL); Michael Padan, Moshav Gan Hashomron (IL)

(73) Assignee: Parma Shutter Technologies, Ltd., Tsemach (IL)

( * ) Notice: Subject to any disclaimer, the term of this patent is extended or adjusted under 35 U.S.C. 154(b) by 470 days.

(21) Appl. No.: 10/543,407

(22) PCT Filed: Jan. 15, 2004

(86) PCT No.: PCT/IL2004/000039

§ 371 (c)(1),
(2), (4) Date: Jul. 26, 2005

(87) PCT Pub. No.: WO2004/070156

PCT Pub. Date: Aug. 19, 2004

(65) Prior Publication Data

US 2006/0113045 A1 Jun. 1, 2006

(30) Foreign Application Priority Data

Jan. 30, 2003 (IL) ..... 154223

(51) Int. Cl.

| | |
|---|---|
| ***E05D 15/00*** | (2006.01) |
| ***E05D 15/26*** | (2006.01) |
| ***E06B 9/30*** | (2006.01) |
| ***E06B 3/12*** | (2006.01) |
| ***E05F 13/00*** | (2006.01) |

(52) U.S. Cl. ..... 160/204; 160/201; 160/207; 160/169; 160/218; 160/188

(58) Field of Classification Search ..... 160/201, 160/181, 130, 169, 35, 172 R, 207, 188, 160/218; 74/424.71, 89.23, 424.94
See application file for complete search history.

(56) References Cited

U.S. PATENT DOCUMENTS

| | | | | |
|---|---|---|---|---|
| 2,179,882 | A | 11/1939 | Durre | |
| 2,253,843 | A * | 8/1941 | Bruns | 160/54 |
| 2,482,082 | A * | 9/1949 | Wahlberg | 74/424.94 |
| 2,776,708 | A * | 1/1957 | Long | 160/169 |
| 3,008,519 | A * | 11/1961 | Hawkins | 160/169 |
| 3,717,195 | A * | 2/1973 | Larranaga | 160/169 |
| 4,846,244 | A | 7/1989 | Rosenfeld | |

(Continued)

*Primary Examiner*—Katherine Mitchell
*Assistant Examiner*—Samuel S Lin
(74) *Attorney, Agent, or Firm*—The Nath Law Group; Jerald L. Meyer; Stanley N. Protigal

(57) ABSTRACT

A stacking mechanism for shutter members of a shutter mechanism, comprising: a rotatable screw with external thread of length L and pitch P1; a plurality of N traveling nuts mounted on the screw, having internal thread of pitch P1 and external thread of pitch P2,P1>P2; an arrester preventing rotation of the nuts within a length L1 of the screw, while allowing sliding; and a threaded member of pitch P2 adapted to engage the external thread of the nuts within a length L2 of the screw. In a first position of the mechanism, the nuts are arranged over the length L1. Upon rotation of the screw, the nuts slide along the screw at rate P1 per 1 turn, transit from L1 to L2, and then slide within the length L2 at a rate P2 per 1 turn, thereby achieving reversibly a second position of the mechanism where they are arranged over the length L2,L2<L1.

20 Claims, 5 Drawing Sheets

U.S. PATENT DOCUMENTS 5,163,494 A 11/1992 MacNeil et al.
5,327,062 A * 7/1994 Byers ..... 318/687
5,469,905 A 11/1995 McKinney et al.
5,603,372 A * 2/1997 Farmont et al. ..... 160/370.21
6,651,724 B1 * 11/2003 Cittadini ..... 160/207

* cited by examiner

DOOR SHUTTER MECHANISM

FIELD OF THE INVENTION

This invention relates to shutter mechanisms for closing openings such as garage doors and shop windows, and more particularly to shutters with a plurality of parallel bars or blades and motion screw.

BACKGROUND OF THE INVENTION

A common type of shutter mechanism for closing a door opening comprises a plurality of shutter members such as parallel plates or blades extending across the opening and movably mounted to opposite sides thereof. In a closed position of the shutter, the blades lie generally in the plane of the opening, with touching or overlapping edges, thereby closing the opening. In an open position of the shutter, the blades are removed from the opening and may be stacked one over the other or collapsed face-to-face or rolled in a roll or just drawn away along the ceiling or a wall, etc. as the design may be. The transition from closed to open position and back is performed by a motion device that may employ pulleys and ropes or chains, scissors lever mechanism, motion screw, etc. and a motor or manual drive. Another common type of shutter has a number of parallel bars connected with transverse elements such as diagonal cross-bars moveable like scissors, or flexible chains, bands, etc. so that these elements obstruct the passage when the parallel bars are in the most spaced position.

For example, U.S. Pat. No. 5,163,494 discloses a sectional door installation comprising a series of horizontal blades mounted with their opposite ends to scissors linkages. The lowermost linkage is raised or lowered by an endless chain whereby all linkages contract or extend simultaneously. The blades are mounted to one of the two levers in a scissors pair and turn together with the lever, so that in the most raised position, the blades are nearly horizontal and are stacked in a tight stack under the upper beam of the doorframe.

U.S. Pat. No. 5,469,905 describes a security and hurricane shutter using blades which are longitudinally pivoted to each other. Every other pivoting axis is supported in a vertical guide at the two opposing sides of the door. The shutter can use either pulleys or motion screw that raises the lowermost blade. Thereby, the whole blade assembly collapses like accordion towards the upper beam of the door.

U.S. Pat. No. 4,846,244 discloses a window shutter comprising a plurality of horizontal blades, a tilting device for simultaneously tilting all the blades about their horizontal axes, and a raising device. The blades are mounted on shafts received within channels at opposite sides of the window. The devices for tilting and raising of the blades employ ropes and pulleys like in Venetian blinds.

The usage of motion screws in shutter mechanisms generally allows more accurate motion than the usage of ropes or chains. However, the stacking of the blades in known shutter mechanisms requires that only one blade is engaged with the screw thread thus overloading this blade while the other blades lose the accuracy of motion.

SUMMARY OF THE INVENTION

In accordance with the present invention, there is provided a stacking mechanism for shutter members of a shutter mechanism comprising:

a rotatable screw with external thread of length L and pitch P1;

a plurality of N traveling nuts mounted on the screw, having internal thread of pitch P1 and external thread of pitch P2 coaxial with the internal thread, P1>P2;

an arrester adapted to engage the traveling nuts so as to prevent their rotation within an axial length L1 of the screw, while allowing the traveling nuts to slide along the screw;

a threaded member with internal thread of pitch P2 adapted to engage the external thread of the traveling nuts within an axial length L2 of the screw, the length L2 being adjacent to the length L1.

The traveling nuts are arranged at intervals $W1_i$, i=1, 2, . . . , N−1, preferably uniform, within the length L1 in a first position of the mechanism. By means of continuous rotation of the screw in one direction, they can slide along the screw within the length L1 at rate P1 per 1 turn of the screw under the action of the arrester and the thread with pitch P1. The nuts can transit smoothly and reversibly from L1 to L2, and can slide with rotation along the screw within the length L2 at a rate P2 per 1 turn of the traveling nut under the action of the thread with pitch P1 and the thread with pitch P2. The nuts can achieve reversibly a second position of the mechanism where they are arranged at intervals $W2_i$, i=1, 2, . . . , N−1 within the length L2, where $W2_i<W1_i$ and L2<L1.

Preferably, the arrester is an elongated member, i.e. an L or C-profile, parallel to the screw, and the traveling nuts have a notch engaging the elongated member while the traveling nuts are within the length L1.

Each traveling nut has a connection element mounted for free rotation about the nut axis and carrying a non-rotating shutter member. The connection element is preferably a ring with an inward rim and a radial pin while the nut has an external annular channel adapted to engage the inward rim.

The threaded member has a cutout parallel to the thread axis so that the connection elements can travel together with the traveling nuts within the length L2. The threaded member may be a toothed rack parallel to the screw, the teeth of the rack constituting thread with pitch P2.

According to another aspect of the present invention, there is provided a shutter mechanism for closing an access aperture, comprising two stacking mechanisms as described above. The stacking mechanisms are disposed parallel to each other at two opposite sides of the access aperture with their threaded members at a third side of the aperture ("stacking side"), their N×2 traveling nuts in symmetric disposition, and their screws adapted for synchronous rotation.

The shutter mechanism further comprises a plurality of N shutter members extending between the stacking mechanisms perpendicularly to their screws, each connected to a pair of connection elements. The shutter members are distributed over the access aperture in the first position of the stacking mechanisms, whereby the access aperture is closed. The shutter members are stacked at the stacking side in the second position of the stacking mechanisms, whereby the access aperture is opened.

In one embodiment of the present invention, the shutter members are flat rectangular blades with long edges and short edges. Each blade is connected to the pair of connection elements by its short edges so that it can swivel about an axis defined by this pair. The blades are disposed approximately in one common plane in the first position of the stacking mechanisms, and are turned away from this common plane in the second position of the stacking mechanisms.

The shutter mechanism further has a pivoting mechanism adapted to swivel each blade away from the common plane before the traveling nuts connected to the blade start their transition from the length L1 to the length L2.

The pivoting mechanism comprises:

- a plurality of N pivoting levers, each one firmly mounted to one short edge of each blade, generally in a plane perpendicular to the blade axis, and having a sliding means, e.g. a roller, at a free end of the lever,
- a guiding means, e.g. a C-profiled guiding member, extending parallel to the screws, with a straight portion at least L1 long. The guiding means is adapted to engage for free sliding the sliding means of each pivoting lever so that each blade preserves its orientation while traveling along the length L1 with the sliding means engaged in the guiding means,
- a pivoting means adapted to turn each blade away from said common plane or to turn each blade into said common plane when a predetermined traveling nut passes a predetermined position along the length L.

In a first embodiment of the pivoting mechanism, the pivoting means is a curved portion of the guiding means adapted to catch for a while the free end of one of the pivoting levers and allow a transverse motion of the free end when the respective blade travels past the curved portion, whereby the pivoting lever turns the respective blade.

The pivoting mechanism may be adapted to swivel all blades away from said common plane simultaneously, before the nearest traveling nut starts its transition from the length L1 to the length L2. In a second embodiment of the pivoting mechanism, the pivoting means is an assembly comprising a movable suspension of the guiding member adapted to displace the guiding member from its initial position transversely to the screw, while preserving the parallel orientation and the engagement with the roller. The pivoting assembly further comprises a latch preventing the displacement of the guiding member when in locked position, an actuator engaged with the screw and adapted to unlock and lock the latch in predetermined positions relative to the screw, a plurality of traps associated with the guiding member and adapted to catch for a while the free end of the lever of each blade when the free end contacts the trap.

All the above members and elements are disposed in such way that, in the process of screw rotation, starting from the first position of the stacking mechanism, the following takes place in succession: the traveling nuts together with the blades and their levers start moving from the length L1 to the length L2, the actuator unlocks the latch and thereby the guiding members, the free ends of the levers are simultaneously caught by their respective trap means, the movable suspension displaces the guiding member from its initial position, the levers turn about their caught free ends and turn the blades away from the common plane, the guiding member returns to its initial position, the free ends are released from their trap, the actuator locks the latch and thereby the guiding members, the nuts and the blades in position away from the common plane continue moving to the length L2.

In a second embodiment of the present invention—a bar-shutter mechanism—the shutter members are elongated bars. A plurality of movable elements connects each two adjacent bars so as to obstruct the passage between the adjacent bars in the first position of the stacking mechanisms (closed position).

In one embodiment of the bar-shutter mechanism, the moveable elements are short slats with one end rotatably mounted to one bar and a second end mounted slidingly and rotatably to the adjacent bar. The moveable elements may be also flexible, such as chains, ropes, mesh, textile, elastic sheets, etc.

The stacking mechanism and the shutter mechanism of the present invention provide for a very accurate and reliable motion of the shutter members. Shutter blades may abut very accurately and tightly in the closed position of the shutter, while fitting in a compact stack in the opened position of the shutter. The traction force is distributed uniformly and simultaneously to all shutter members. The parts and assemblies of the mechanism are robust and sturdy. The construction excludes any possibility of bar or blade misalignment in operation, jamming, locking or seizure of the moving parts.

BRIEF DESCRIPTION OF THE DRAWINGS

In order to understand the invention and to see how it may be carried out in practice, preferred embodiments will now be described, by way of non-limiting example only, with reference to the accompanying drawings, in which.

DETAILED DESCRIPTION OF THE INVENTION

Figure 1A:
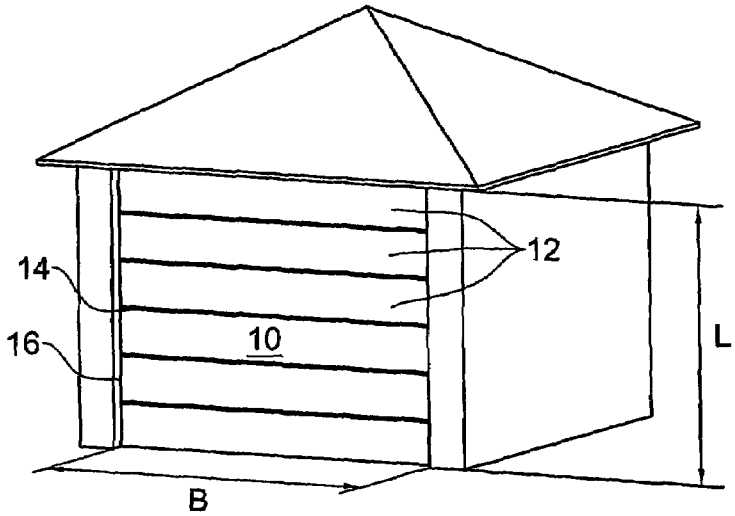
FIGS. 1A, 1B and 1C are external perspective views of a garage door with the shutter mechanism of the present invention, in three positions.
Figure 1B:
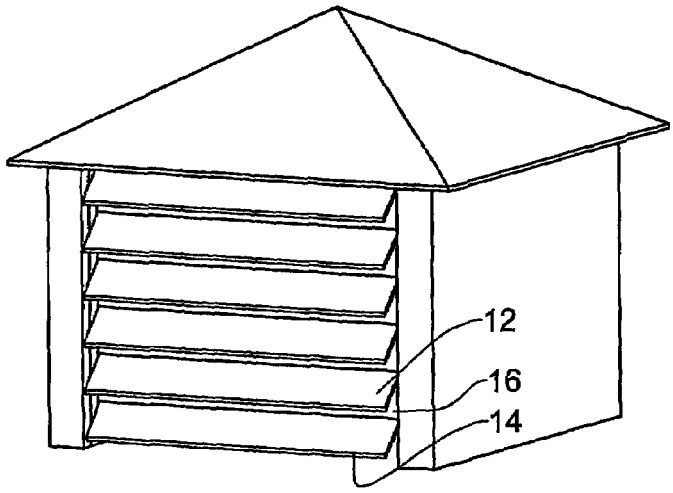
Figure 1C:
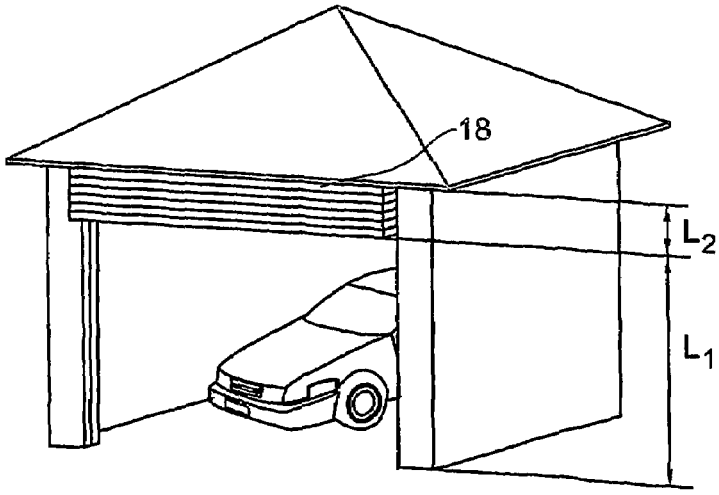

With reference to FIGS. 1A, 1B and 1C, there are shown external perspective views of a garage shutter 10 with the shutter mechanism of the present invention, the shutter closing an aperture with height L and width B. The shutter 10 comprises a plurality of shutter blades 12 with long edges 14 and short edges 16. In a closed position of the shutter shown in FIG. 1A, the blades 12 lie generally in the plane of the aperture with touching or overlapping long edges 14. In an intermediate position shown in FIG. 1B, the blades 12 are pivoted about axes parallel to the long edges, providing access for air or light. In an open position of the shutter shown in FIG. 1C, the plurality of shutter blades are stacked in a neat stack 18 under the upper beam of the shutter. The stack occupies height L2 leaving a free clearance of height L2.

Figure 2:
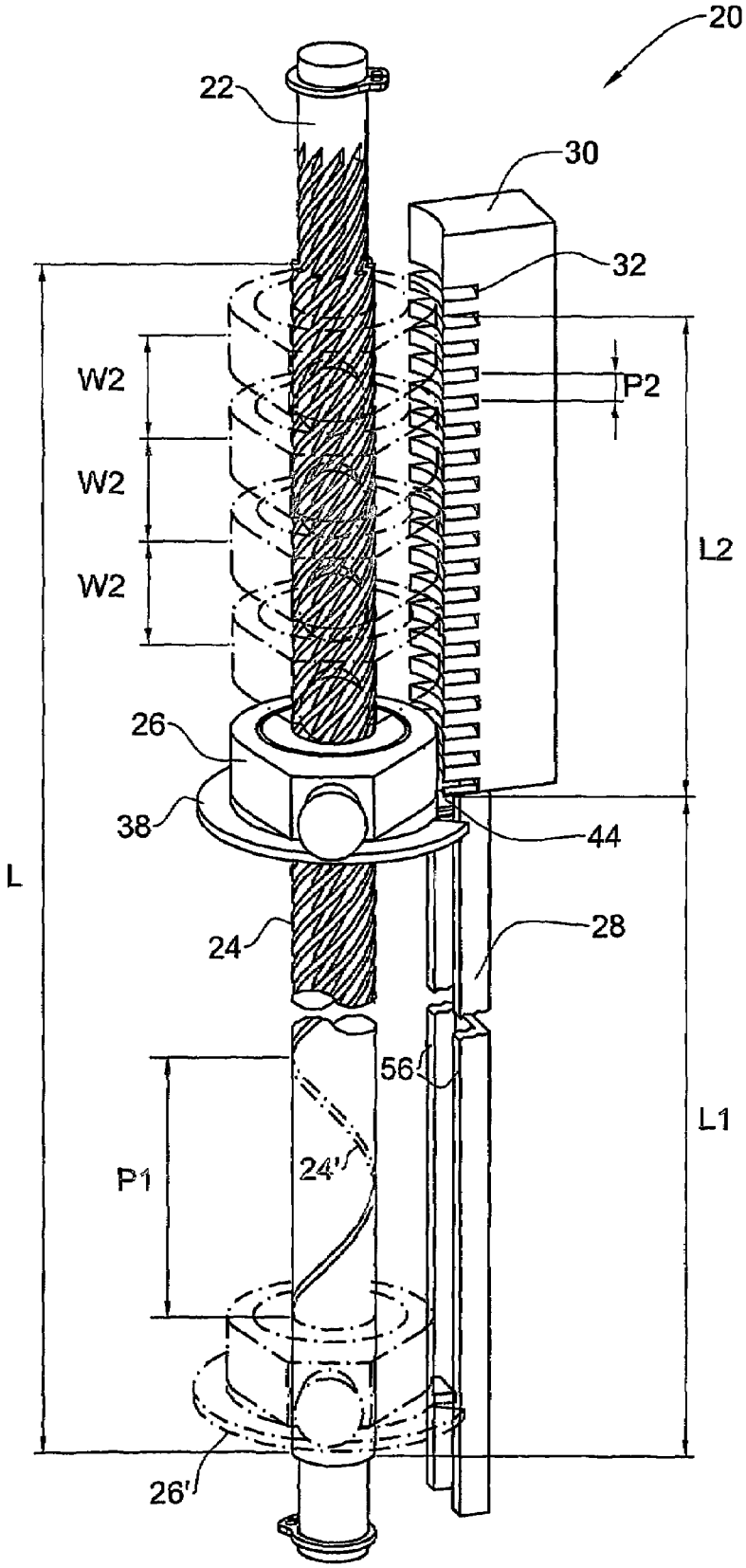
FIG. 2 is a perspective view of a stacking mechanism according to the present invention.

The stacking mechanism and the construction of the whole shutter mechanism are described in greater detail in the following figures. With reference to FIG. 2, there is shown a stacking mechanism 20 comprising a rotary screw 22 with external thread 24, traveling nuts 26 mounted thereon, an arrester 28, and a threaded member 30 with internal thread 32.

The screw 22 has length L and its thread 24 is multi-start thread with pitch P1 (one turn thereof is shown under number 24').

Figure 4A:
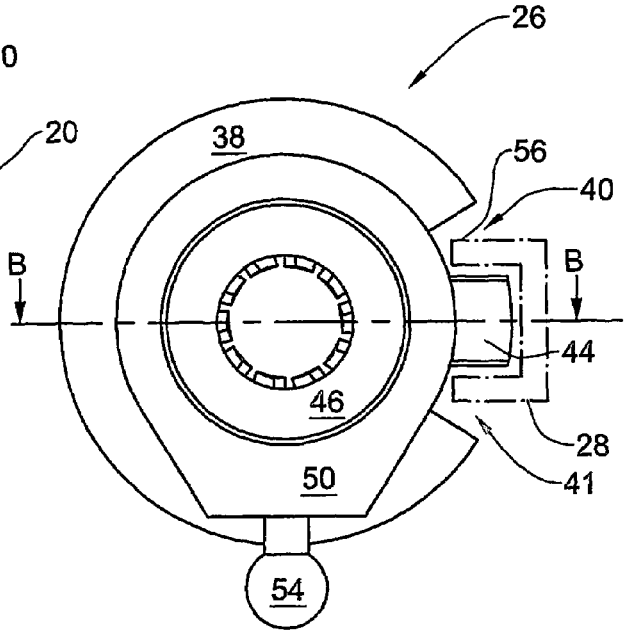
FIGS. 4A and 4B are a plan view and a sectional elevation respectively of a traveling nut according to the present invention.
Figure 4B:
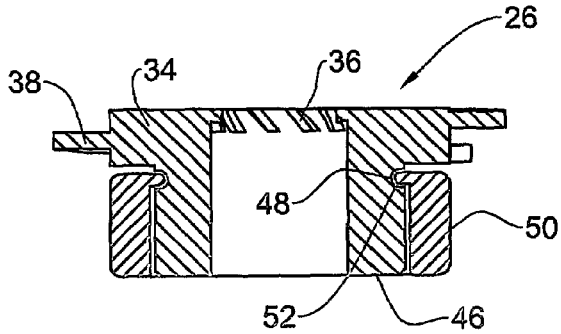

With reference also to FIGS. 4A and 4B, the traveling nut 26 has a body 34 with internal thread 36 of pitch P1 matching the external thread 24 and external thread 38 with pitch P2, coaxial with the internal thread. The pitch of the thread P1 is much greater than the pitch P2. The external thread has less than one turn and is formed with two notches 40 and 41, leaving a tooth 44 therebetween. The tooth 44 is at the end of the thread 38 turn. The nut body 34 also has a cylinder part 46 with an annular channel 48. A connection element formed as a ring 50 with an inward rim 52 is mounted on the nut body 34, the rim engaging the channel 48 so that the ring can rotate freely about the nut body but can not be displaced axially. The connection element has a radial pin 54 externally attached to the ring 50 which is a part of an articulate joint with the shutter blades 12.

The arrester 28 is an elongated member with C-like cross-section, of length L1 disposed parallel to the screw. The sides 56 of the C-section engage the notches 40 and 41 of the nut 26, as shown in FIG. 4A.

The treaded member 30 is formed as a tooth rack parallel to the screw 22, the teeth constituting the internal thread 32 with pitch P2, matching the thread 38 on the nut 26. The member 32 has length L2 and is disposed adjacent the arrester 28.

The stacking mechanism 20 operates as follows. With initial position of the traveling nut 26' within the length L1 of the screw, the screw 22 starts uniform rotation in one direction. Within the length L1, the traveling nut 26 is engaged with the arrester 28 by means of the tooth 44 and notches 40 and 41 which prevents the rotation of the nut. Therefore, the nut slides along the screw 22 at rate $l_1$=P1 per 1 turn of the screw. When the traveling nut 26 reaches the end of the arrester 28 at the boundary between lengths L1 and L2, the tooth 44 disengages from the arrester 28. At the same time, the tooth 44 abuts the start of the thread in the threaded member 30 which stops the sliding of the nut along the screw 22. But now the nut 26 is able to rotate together with the screw 22, the tooth 44 and the whole thread 38 following the internal thread 32. Therefore, when within the length L2, the nut performs a complex motion including rotation with the screw 22 but with angular sliding, and linear translation at rate P2 per 1 turn of the nut. The linear travel 12 of the nut per one turn of the screw is:

$$l_2=(P1\times P2)/(P1+P2)$$

Upon reverse rotation of the screw, the nut travels back from the length L2 to the length L1 with smooth transition. It will be readily appreciated that if two nuts 26 are positioned initially at a distance W1 on the length L1 of the screw 22, after both nuts pass over to the length L2, they will be positioned at a distance W2:

$$W2=(W1\times P2)/(P1+P2)$$

Figure 3:
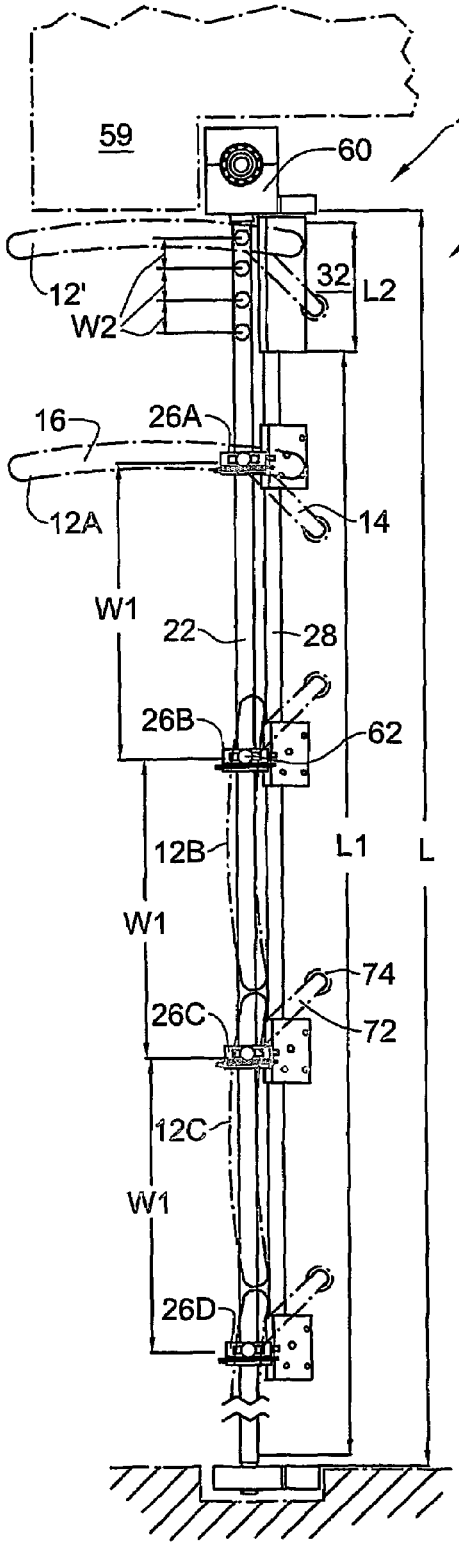
FIG. 3 is an elevation of the stacking mechanism of FIG. 2 as used in a door shutter.

With reference also to FIG. 3, when the stacking mechanism 20 of the present invention is used with a plurality of N traveling nuts 26 arranged at uniform intervals W1 within the length L1 in a first position of the mechanism, then by rotation of the screw, the stacking mechanism will be able to transit reversibly the N traveling nuts into a second position within the length L2 where the nuts will be "compressed" at uniform intervals W2. It will be appreciated that by selecting the thread pitches P1 and P2, different coefficient of "compression" W1/W2 may be achieved.

The stacking mechanism of the present invention is advantageously used in the shutter mechanism 10 shown externally in FIG. 1. With reference also to FIG. 3, the shutter mechanism 10 comprises two identical stacking mechanisms 20 (only one is shown). The stacking mechanisms 20 are disposed parallel to each other at two opposite sides of the access aperture with their threaded members 30 beside the upper beam of the doorframe. A driving unit 60 is provided for synchronous rotation of the two screws 22. The screws carry each N traveling nuts 26A, 26B, etc. in symmetric disposition.

The shutter mechanism 10 further comprises a plurality of N flat rectangular blades 12 with long edges 14, short edges 16 of width W1, and thickness T<W2. The short and long edges of the blades are disposed approximately in one common plane (the plane of the aperture) in the first position of the stacking mechanisms, as shown by blades 12B and 12C, whereby the access aperture is closed. The blades are stacked under the upper beam 59, turned perpendicularly to the common plane, in the second position of the stacking mechanisms, as shown by blade 12', whereby the access aperture is opened.

With reference also to FIGS. 4A and 4B, each traveling nut 26 has a ring connection element 50 mounted for free rotation about the nut axis. The ring 50 is mounted to the short edge 16 of a blade 12 by means of a rotary articulated joint 62 so that each blade can swivel about a blade axis defined by two joints 62.

Figure 5A:
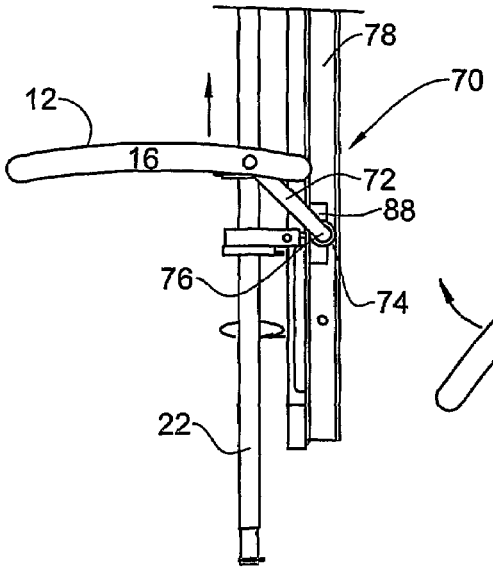
FIGS. 5A, 5B and 5C are side elevations of the pivoting mechanism according to the present invention, in three successive positions.
Figure 5B:
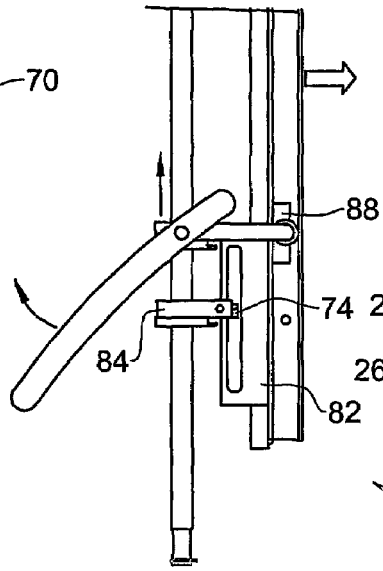
Figure 5C:
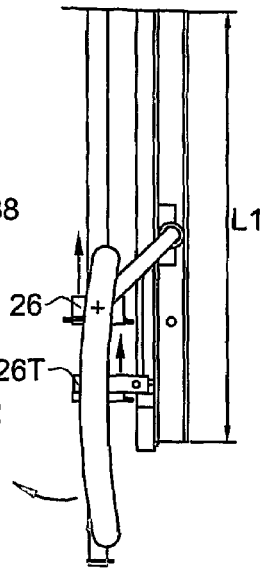

With reference also to FIGS. 5A, 5B and 5C, the shutter mechanism further has a pivoting mechanism 70 adapted to swivel each blade away from the common plane before the traveling nuts 26 connected to the blade start their transition from the length L1 to the length L2. The pivoting mechanism 70 comprises:

a) N pivoting levers 72, each one firmly mounted to one short edge 16 of each blade, generally in a plane perpendicular to the blade axis. Each lever 72 has a roller 74 at its free end 76;

b) A guiding member 78 extending parallel to the screw 22. The guiding member 78 has a channel profile (C-shaped cross-section) which engages the roller of each pivoting lever while the blade is traveling along the screw;

c) A movable suspension (not shown) of the guiding member allowing the guiding member to be displaced from its initial position transversely to the screw, while preserving the parallel orientation and the engagement with the roller;

d) A latch 82 preventing the displacement of the guiding member 78 and disposed at the lower end of the guiding member;

e) an actuator 84 engaged with the screw 22 and adapted to unlock and lock the latch 82. The actuator 84 is actually a traveling nut 26T that carries a finger 85 adapted to engage the latch 82 when moving past the latch.

f) A plurality of N traps 88 (recesses) disposed on the guiding member 78 at intervals W1. The traps 88 are adapted to catch for a while the free end of the lever of each blade when its roller falls into the trap.

The shutter mechanism 10 operates in the following way. In the first position of the stacking mechanism (FIG. 5C and FIG. 3), the blades 12 are in the common plane, the travelling nuts are on the length L1 of the screw, spaced at intervals W1 from each other and engaged in the arrester 28. The levers 72 are orientated upwards, with rollers 74 in the guiding member 78 which is locked by means of the latch 82. When the drive 60 starts to rotate the screws 22, the blades 12 start moving upwards. The actuator 84 unlocks the latch 82 and in the next moment the rollers 74 are simultaneously caught by the traps 88. The levers 72 push the guiding member 78 aside and the movable suspension allows the displacement. Thereby, the levers 72 turn about their caught free ends 76 and turn the blades 12 away from the common plane (FIG. 5B). In the following travel of the blade, the turning of the levers 72 continue but now the caught free ends 76 pull the guiding member 78 to its initial position. The actuator 84 disengages from the latch 82, whereby the guiding member 78 is locked in its initial position. The levers 72 therefore quit turning and the rollers 74 are pulled out of the traps. All blades are now pivoted perpendicular to the common plane and in the further motion transit from the length L1 to the length L2 and are stacked under the upper beam spaced at interval W2.

During the upward motion, the rollers 74 successively fall into next traps 88 but the actuator 84 cannot engage the latch anymore. Therefore, the rollers 74 are pulled out without turning the levers 72.

It should be appreciated that in the reverse (downward) motion, the operation proceeds exactly in the reverse order.

Figure 6A:
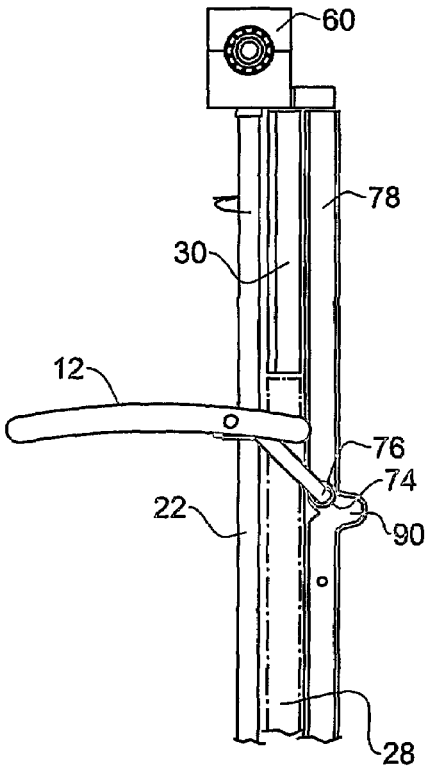
FIGS. 6A, 6B and 6C are side elevations of another embodiment of the pivoting mechanism, in three successive positions.
Figure 6B:
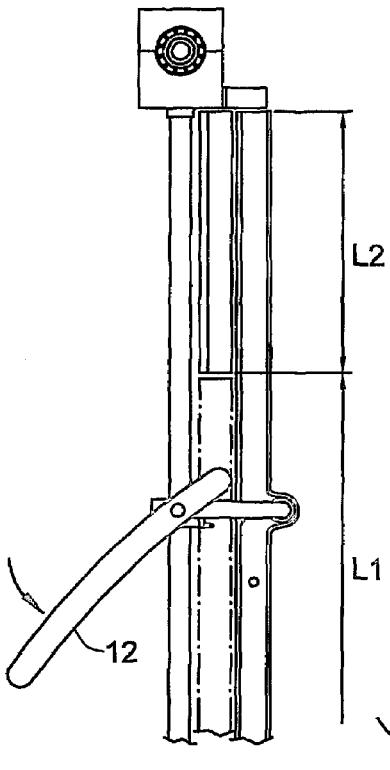
Figure 6C:
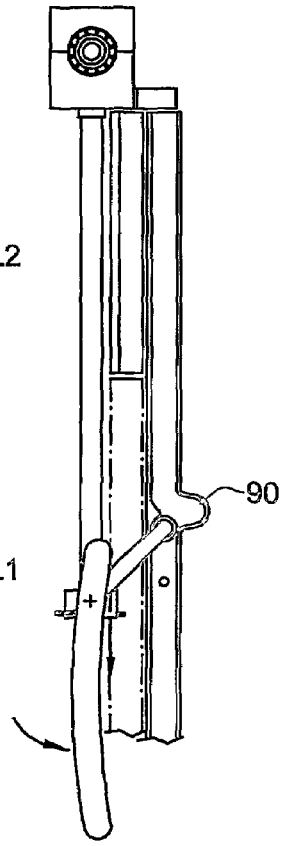

The pivoting mechanism may be adapted to swivel each blade away from the common plane just before its traveling nuts start their transition from the length L1 to the length L2. A second embodiment of the pivoting mechanism shown in FIGS. 6A, 6B and 6C comprises the same parts as in items (a) and (b) above but has a simplified turning arrangement, consisting of a single curved portion 90 of the guiding member 78. This curved portion is configured to catch for a while the roller 74 of the lever 72 and to allow a transverse motion of the free end 76 when the respective blade 12 travels past the curved portion. It will be appreciated from the figures, that the pivoting works both ways. In this case, the blades preserve their closed position in the common plane all the way before the length L2.

Figure 7A:
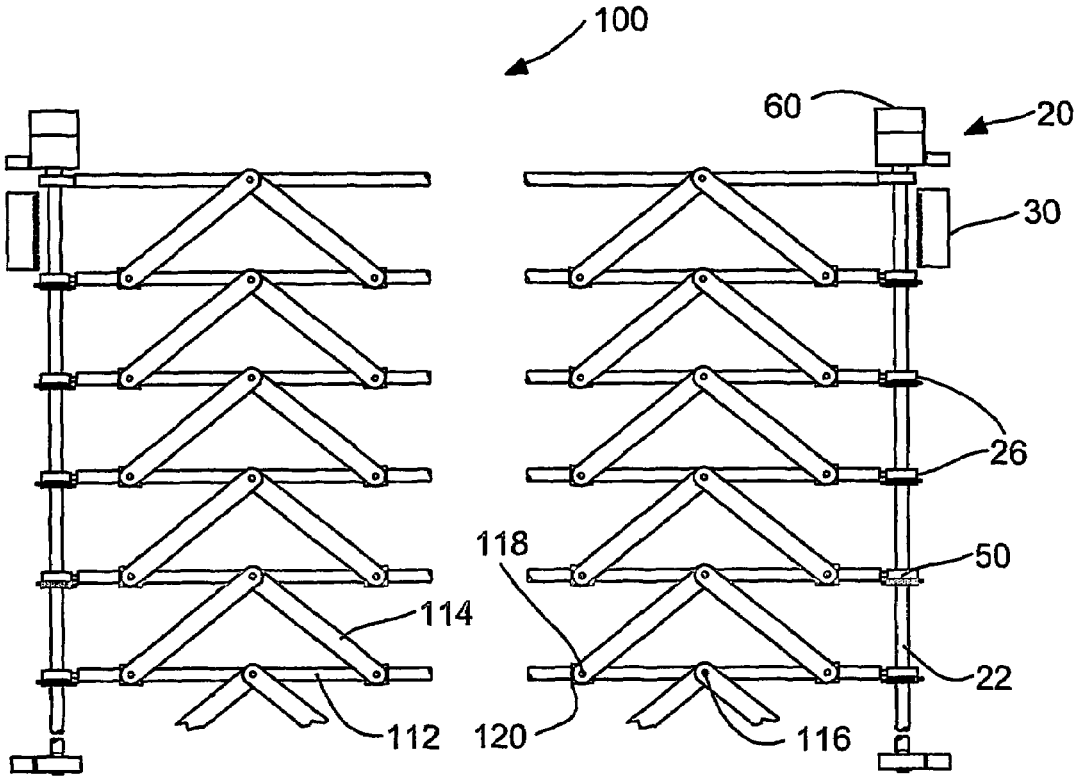
FIGS. 7A and 7B are elevations of a bar shutter with the stacking mechanism according to the present invention, in closed and in opened position, respectively.
Figure 7B:
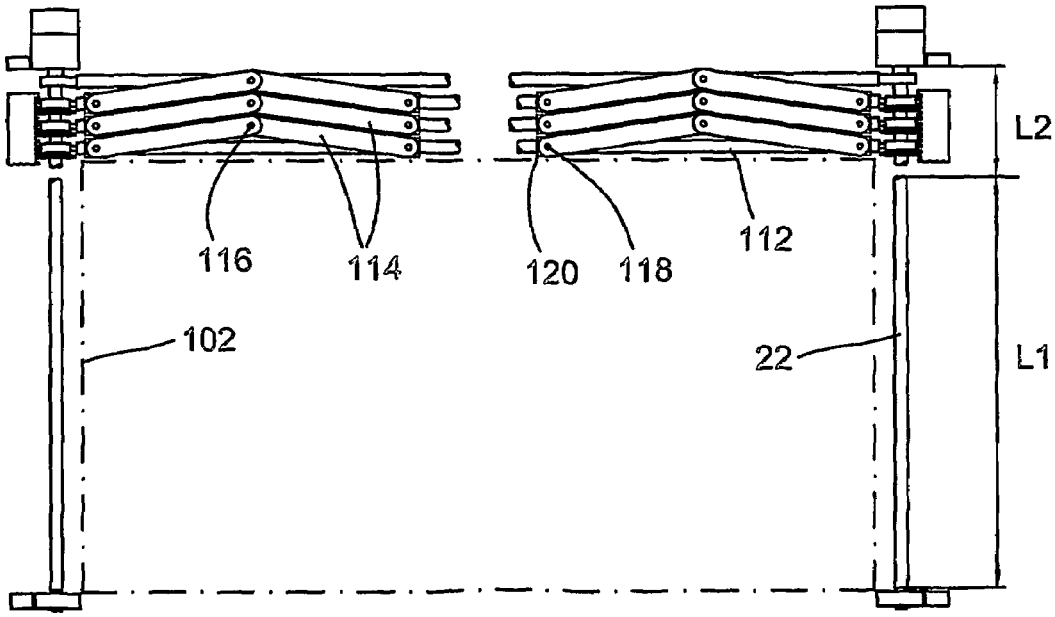

Another application of the stacking mechanism is shown in FIGS. 7A and 7B. A bar-shutter mechanism 100 for the opening 102 comprises two stacking mechanisms 20 disposed parallel to each other at two opposite sides of the access aperture with their threaded members 30 at the upper side of the doorframe. Screws 22, traveling nuts 26, and driving units 60 are similar to those described above. The bar-shutter 100 further comprises a plurality of N bars or rods 112 with ends mounted to the ring connection elements 50 of the traveling nuts 26. Each two adjacent bars are connected by diagonal slats 114. One end of the slat 114 is mounted for rotation on a pin 116 fixed to the upper bar, while the other end is mounted for rotation on a pin 118 fixed to a sleeve 120 which is slidingly mounted on the lower bar.

In the first position (FIG. 7A) of the stacking mechanisms 20, the nuts 26 and the bars 112 are spaced vertically across the access opening 102, in the range L1. The diagonal slats 114 span the space between each two bars dividing it into small cells and precluding passage of persons. In the second position (FIG. 7B) of the stacking mechanisms 20, the nuts 26 and the bars 112 are in "compressed" state at the upper side of the access opening, in the range L2. The bars 112 are close to each other, the sleeves 120 slide away from the pins 116 and the slats 114 acquire nearly horizontal position. The opening 102 is free for passage.

It would be appreciated that elements which extend between the bars 112 may be of various nature, such as flexible chains, ropes, mesh, textile, elastic sheets, etc.

Although a description of specific embodiments has been presented, it is contemplated that various changes could be made without deviating from the scope of the present invention. For example, the present invention could be modified and used with gates, windows, awnings, blinds and other kinds of closures where precise motion and reliable closing is needed. The shutter mechanisms may be mounted with vertical screws, with horizontal screws and in any orientation of the access aperture plane.

The invention claimed is:

1. A nut stacking mechanism comprising:

a rotatable screw with external thread of length L and pitch P1;

at least one traveling nut mounted on said screw, said traveling nut having internal thread of pitch P1 and external thread of pitch P2 coaxial with said internal thread, P1>P2;

an arrester adapted to engage said traveling nut so as to prevent rotation thereof within an axial length L1 of said screw, while allowing said traveling nut to slide along said screw;

a threaded member with internal thread of pitch P2 adapted to engage the external thread of said traveling nut within an axial length L2 of said screw, said length L2 being adjacent to said length L1, so that, by means of continuous rotation of said screw in one direction, said traveling nut can slide along said screw within said length L1 at rate P1 per 1 turn of the screw under the action of said arrester and said thread with pitch P1, can transit smoothly and reversibly from L1 to L2, and can slide with rotation along said screw within said length L2 at a rate P2 per 1 turn of the traveling nut under the action of said thread with pitch P1 and said thread with pitch P2.

2. The stacking mechanism of claim 1 used for stacking shutter members of a shutter mechanism, wherein a plurality of N traveling nuts are mounted on said screw;

said N nuts are arranged at intervals $W1_i$, i=1, 2, . . . , N−1, within said length L1 in a first position of said mechanism so that, by mean of continuous rotation of said screw in one direction, said traveling nuts can slide along said screw , can transit smoothly and reversibly from L1 to L2, and can achieve reversibly a second position of said mechanism where said N nuts are arranged at intervals $W2_i$, i =1, 2, . . . , N−1 within said length L2, where $W2_i<W1_i$ and L2<L1.

3. The stacking mechanism according to claim 2, wherein said arrester is an elongated member parallel to said screw, each of said traveling nuts has a notch parallel to said screw, and said elongated member is received in said notch while said traveling nuts are within said length L1.

4. The stacking mechanism according to claim 3, wherein each traveling nut comprises a connection element mounted thereon for free rotation and adapted to carry a non-rotating shutter member while traveling within said length L, and said threaded member has a cutout allowing said connection element to travel together with the traveling nut thereof within said length L2.

5. The stacking mechanism according to claim 4, wherein said threaded member is a toothed rack parallel to said screw, the teeth of said rack constituting said thread with pitch P2.

6. The stacking mechanism according to claim 5, wherein said connection element comprises a ring with an inward rim and a radial pin externally attached to said ring, the respective traveling nut has an annular channel at an external surface thereof, and said rim is engaged in said channel so that the ring can rotate freely about the nut but can not be displaced axially therefrom while said pin is mounted to said non-rotating shutter member.

7. Two nut stacking mechanism, each comprising:

a rotatable screw with external thread of length L and pitch P1;

at least one traveling nut mounted on said screw, said traveling nut having internal thread of pitch P1 and external thread of pitch P2 and coaxial with said internal thread, P1>P2;

an arrester adapted to engage said traveling nut so as to prevent rotation thereof within an axial length L1 of said screw, while allowing said traveling nut to slide along said screw; a threaded member with internal thread of pitch P2 adapted to engage the external thread of said traveling nut within an axial length L2 of said screw, said length L2 being adjacent to said length L1, so that, by means of continuous rotation of said screw in one direction, said traveling nut can slide along said screw within said length L1 at rate P1 per 1 turn of the screw under the action of said arrester and said thread with pitch P1, can transit smoothly and reversibly from L1 to L2, and can slide with rotation along said screw within said length L2 at a rate P2 per 1 turn of the traveling nut under the action of said thread with pitch P1 and said thread with pitch P2;

said two nut stacking mechanisms, are disposed parallel to each other at two opposite sides of said access aperture with their threaded members at a third side of said access aperture, referred as "stacking side", with their nuts in symmetric disposition, and their screws adapted for synchronous rotation, a plurality of N shutter members extending between said stacking mechanisms perpendicularly to the screws thereof, each connected to a pair of said connection elements, said shutter members being distributed over said access aperture in the first position of the stacking mechanisms, whereby said access aperture is closed, and said shutter members being stacked at said stacking side in the second position of the stacking mechanisms, whereby said access aperture is opened.

8. The shutter mechanism according to claim 7, wherein said intervals $W1_i$ and $W2_i$ of the stacking mechanisms are uniform.

9. The shutter mechanism according to claim 7, wherein said N shutter members are flat rectangular blades having long edges and short edges, each blade is connected by its short edges to a pair of said connection elements so that said blade can swivel about an axis defined by said pair, said blades are disposed approximately in one common plane in the first position of the stacking mechanisms and are turned away from said common plane in the second position of the stacking mechanisms.

10. The shutter mechanism according to claim 9 further comprising a pivoting mechanism adapted to swivel each blade away from said common plane before the traveling nuts associated with each blade start their transition from the length L1 to the length L2 and to swivel each blade into said common plane after said traveling nuts transit from the length L2 into the length L1.

11. The shutter mechanism according to claim 10, wherein said pivoting mechanism comprises:

a plurality of N pivoting levers, each one firmly mounted to one short edge of each of said N blades, generally in a plane perpendicular to said blade axis, and having a sliding means at a free end of the lever, a guiding means extending parallel to said screws, with a straight portion at least L1 long, the guiding means being adapted to engage for free sliding said sliding means of each pivoting lever so that each blade preserves its orientation while traveling along the length L1 with said sliding means engaged in said guiding means.

12. The shutter mechanism according to claim 11, wherein said sliding means is a roller.

13. The shutter mechanism according to claim 11, wherein said guiding means is a C-shaped profile.

14. The shutter mechanism according to claim 11, wherein said pivoting mechanism further comprises a pivoting means adapted to turn each blade away from said common plane or into said common plane when a predetermined traveling nut of said N nuts passes a predetermined position along the length L1.

15. The shutter mechanism according to claim 14, wherein said pivoting means is a curved portion of said guiding means adapted to catch for a while said free end of said lever and allow a transverse motion of said free end when the respective blade travels past said curved portion, whereby said lever turns the respective blade, said predetermined nut being a nut associated with said respective blade.

16. The shutter mechanism according to claim 14, wherein said pivoting means is adapted to turn simultaneously all blades away from said common plane or into said common plane when a predetermined traveling nut of said N nuts passes a predetermined position along the length L1.

17. The shutter mechanism according to claim 16, wherein said pivoting means comprises a movable suspension of said guiding means adapted to displace said guiding means from its initial position transversely to said screw preserving the parallel orientation and the engagement with said sliding means, a locking means preventing the displacement of the guiding means when in locked position, an actuating means engaged with said screw and adapted to unlock and lock said locking means in predetermined positions relative to said screw, trap means associated with said guiding means and adapted to catch for a while said free end of said lever of each blade when said free end contacts said trap means, all the above means disposed in such way that, in the process of screw rotation, starting from the first position of the stacking mechanism, the following takes place in succession: the traveling nuts together with the blades and their levers start moving from the length L1 to the length L2, the actuator unlocks the locking means and thereby the guiding means, the free ends of the levers are simultaneously caught by their respective trap means, the movable suspension displaces the guiding means from its initial position, the levers turn about their caught free ends and turn the blades away from the common plane, the guiding means return to its initial position, the free ends are released from their trap means, the actuator locks the locking means and thereby the guiding means, the nuts and the blades in position away from the common plane continue moving to the length L2.

18. The shutter mechanism according to claim 7, wherein said N shutter members are elongated bars, the shutter mechanism further comprising a plurality of transverse elements movably connecting at least two adjacent bars of the N elongated bars so as to obstruct passage between said at least two adjacent bars in the first position of the stacking mechanisms.

19. The shutter mechanism according to claim 18, wherein said transverse elements are rigid slats with one end mounted rotatably to one of said a least two bars and a second end mounted slidingly and rotatably to the second of said two bars.

20. The shutter mechanism according to claim 18, wherein said transverse elements are at least one of the following: chains, ropes, net, mesh, textile, and elastic sheets.

* * * * *